United States Patent [19]

Reffert

[11] Patent Number: 4,491,310

[45] Date of Patent: Jan. 1, 1985

[54] ADJUSTABLE FOLDING APPARATUS

[75] Inventor: Roland Reffert, Frankenthal, Fed. Rep. of Germany

[73] Assignee: Albert-Frankenthal AG, Frankenthal, Fed. Rep. of Germany

[21] Appl. No.: 570,267

[22] Filed: Jan. 12, 1984

[30] Foreign Application Priority Data

Jan. 22, 1983 [DE] Fed. Rep. of Germany ..... 3302036

[51] Int. Cl.[3] ..... B42C 1/04

[52] U.S. Cl. ..... 270/49; 270/50; 270/60

[58] Field of Search ..... 270/58, 60, 47–50

[56] References Cited

U.S. PATENT DOCUMENTS

| | | | |
|---|---|---|---|
| 1,055,497 | 3/1913 | Sheldon | 270/60 |
| 1,242,909 | 10/1917 | Barber | 270/49 |
| 1,392,470 | 10/1921 | Wood | 270/49 |
| 2,278,188 | 3/1942 | Bamford et al. | 270/60 |
| 3,921,968 | 11/1975 | Thomas et al. | 270/60 |
| 4,094,499 | 6/1978 | Thomas | 270/60 |
| 4,279,410 | 7/1981 | Bolza-Schunemann | 270/50 X |
| 4,344,610 | 8/1982 | Jeschke et al. | 270/60 |
| 4,381,106 | 4/1983 | Loebach | 270/47 |

FOREIGN PATENT DOCUMENTS

| | | | |
|---|---|---|---|
| 51564 | 1/1912 | Austria | 270/49 |
| 2512368 | 9/1976 | Fed. Rep. of Germany | 270/60 |
| 106227 | 8/1924 | France | 270/49 |

*Primary Examiner*—E. H. Eickholt

*Attorney, Agent, or Firm*—Collard, Roe & Galgano

[57] ABSTRACT

For manufacture of booklets consisting of an inner portion and a cover having material different than the inner portion on a folding apparatus including a collecting cylinder, two successively-disposed band guidances associated with the collecting cylinder, surrounding two successively-disposed peripheral segments of the collecting cylinder. One band guidance surrounding the rear peripheral segment transports web segments from which the inner portion is assembled to the collecting cylinder, while the other band guidance which surrounds the front peripheral segment delivers web segments forming a cover to the collecting cylinder. The collecting cylinder is provided with holding members which grip the leading edges of the web segments being set thereon, the holding members being activated in the region of the front peripheral segment. The holding members being inactivated following the completed collection process after passing the folding flap cylinder associated with the collecting cylinder.

19 Claims, 2 Drawing Figures

ADJUSTABLE FOLDING APPARATUS

Figures 1, 2:
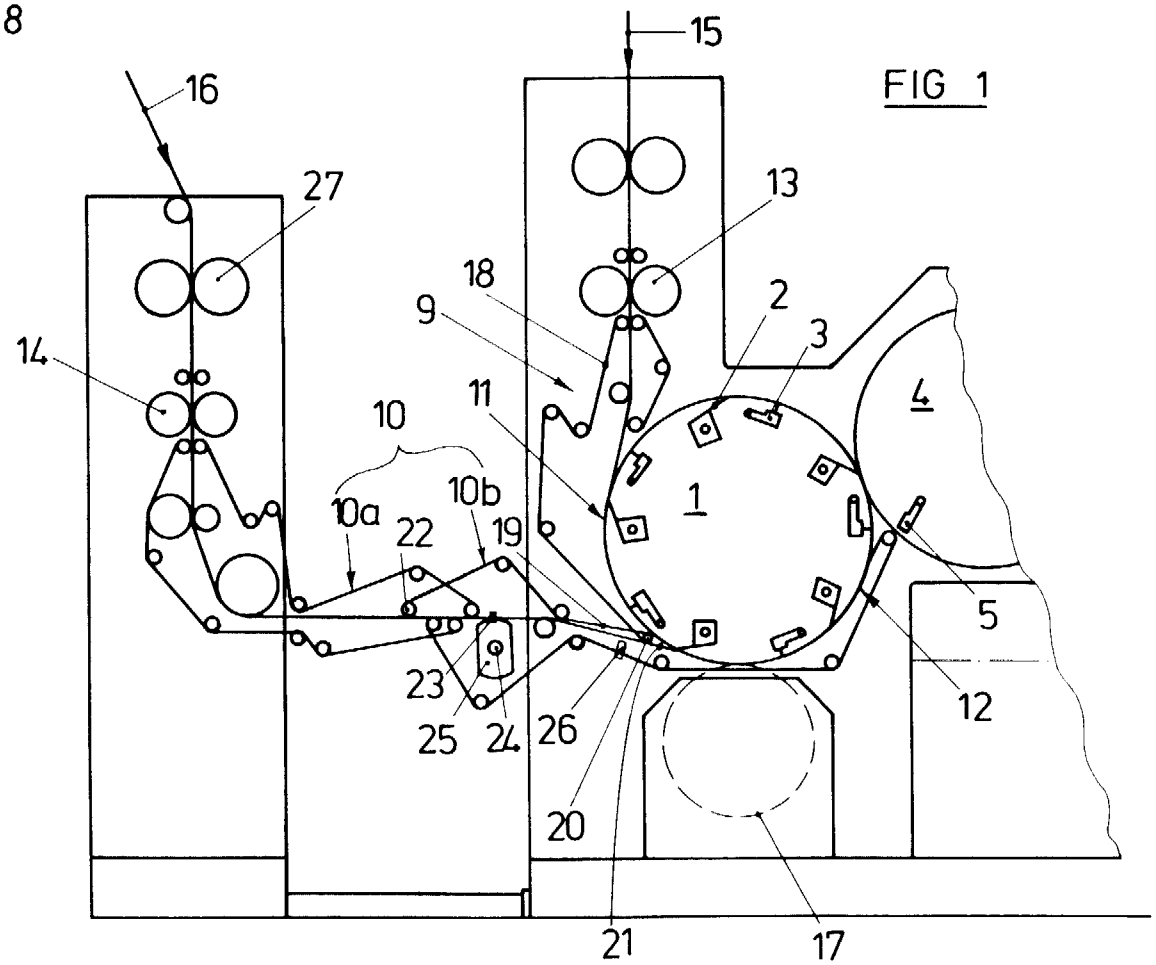

The present invention relates to an adjustable or variable folding apparatus which includes a collecting cylinder, an associated folding flap cylinder, wherein the peripheral segment of the collecting cylinder ahead of the folding flap cylinder is surrounded by guidance bands, the collecting cylinder being provided with controlled holding members for web segments supplied to the collecting cylinder at each rotation thereof by means of the guidance bands, the web segments being superimposed on one another and transferred to the folding flap cylinder.

In known devices of this kind, the collecting cylinder is normally supplied with web segments by means of a band guidance which surrounds the collecting cylinder, wherein a transverse cutter is located upstream of the collecting cylinder so as to subdivide a web of materials supplied thereto into sheet-like web segments, the web of material normally having several layers. A stapler is provided for stapling the web segments together and the web segments are superimposed on one another so that the folding apparatus delivers completely manufactured products or so-called final products. Many journals consist, however, of an inner portion as well as a cover of a material different from that of the inner portion, and preferably made of stronger material. Such products have hitherto not been manufactured in a satisfactory manner in folding devices of the aforementioned kind. The reason therefor can be seen in that during each collection process several web segments are superimposed upon one another. The segments of the multi-layered material web which are associated with the cover sheet are therefore located not only at the location of the cover, but also in the region of the inner portion of the manufactured product. To the extent that the layers or sheets of the multi-layered web of material supplied to the transverse cutter, and associated with the cover consist of thicker material than the remaining sheets, there results not only a thicker cover, but also thicker inner sheets, which is undesirable. For this reason, the complete manufacture of such products in a folding apparatus has not been possible. Rather, it is necessary to assemble the inner portion and the cover in a bookbinder shop which, in turn, requires a considerable effort as far as personnel, transportation and storage is concerned.

It is true that experiments have been conducted with folding devices of a firm format for the manufacture of final products of the above-described type. In such cases material webs have been supplied to the folding apparatus which were respectively associated with the inner portion or the cover. An accelerating path has been postcoupled to, or located downstream of the transverse cutter employed for manufacturing the covers. But it was not the collecting cylinder, to which these webs of materials were supplied directly, but a transverse cylinder located ahead or upstream of the collecting cylinder, to which were also supplied the segments of the web forming the inner portion. Use of such a transverse cylinder is, however, rather expensive. Furthermore, accessability of the collecting cylinder is considerably limited thereby. A further disadvantage can be seen in that, as a result of the use of an additional transverse cylinder, the number of transfer processes is increased, and wherein each transfer process carries therewith the risk of a certain inaccuracy.

It is, therefore, an object of the present invention to devise a variable or adjustable folding apparatus of the initially-described kind, in which manufacture of final products having an inner portion and a cover of a material different than that of the inner portion is possible within the folding apparatus, and which is nevertheless simply constructed and insures a high degree of reliability in operation and accuracy in manufacture.

This object, as well as others which will hereinafter become apparent, is accomplished according to the present invention, by the collecting cylinder which cooperates with two band guidances which surround two successively-positioned peripheral segments of the collecting cylinder, one positioned behind the other as seen in the direction of rotation, so as to be free of any slip between the bands and the collecting cylinder. The collecting cylinder is impacted on, receives and collects thereon the web segments forming the inner portion of a booklet to be manufactured at successive rotations of the collecting cylinder by means of the band guidance surrounding the rear peripheral segment, the collecting cylinder is further impacted on by, and receives the web segments forming at least one cover of the respective booklet to be manufactured by means of the band guidance surrounding the front peripheral segment. This is accomplished while appropriate gaps corresponding to the collection process are maintained. The holding members of the collecting cylinder, which are formed as flat grippers and are associated with the leading edges of the sheet, are activated at each rotation of the collecting cylinder within a region of the peripheral segment surrounded by the band guidance supplying the cover web segments, the holding members are inactivated at each transfer of the superimposed web segments to the folding flap cylinder within the peripheral region after the folding flap cylinder.

These features permit a direct supply to the collecting cylinder of both the sheets of the inner portion as well as the cover sheets. This results in a simple, space-saving and compact construction of the folding apparatus, and a good accessibility of the collecting cylinder, which in turn results in very easy maintenance and easy operation. In addition, the apparatus ensures a high degree of manufacturing accuracy since the web segments associated with the covers are directly delivered at a peripheral velocity corresponding to the velocity of the collecting cylinder to the web segments forming the inner portion collected thereon, so that the number of transfer locations are thereby reduced. Due to the fact that the cover segments fill a gap corresponding to the collection process, it is ensured that the inner portion in its entirety can consist of a different material than the associated cover sheet. The holding members of the collecting cylinder, which may be formed as simple grippers, which provide a follow-on grip during each rotation of the collecting cylinder, accomplish this follow-on grip process in an advantageous manner, when all web segments of the complete booklet are superimposed upon one another, which results in a reliable transfer to the folding flap cylinder. The collecting process which is made possible here, in spite of the separate supply of the cover sheets for assembling with the inner portion, allows a large number of pages of the inner portion to be obtained with the aid of an imprinted paper track, which, in an advantageous manner, can be processed in a printing machine.

The separately supplied covers can be taken from a prefabricated roll, which has not only a positive effect on the operation, but insures in an advantageous manner that the colors of the cover sheets have already reached a high degree of dryness, so that a high acceleration in the region of the band guidance for the provision of gaps corresponding to the collection process in the region of the inner portion has no deleterious effect. The advantages obtainable with the invention can therefore be seen to be an excellent economic utilization.

In further advantageous development of the above-described measures, the bands of the band guidances cooperating with the collecting cylinder can be laterally displaced or off-set with respect to one another at least by the width of the band. In this manner, a mutual prong-like engagement or overlapping of both band guidances is possible, so that in an advantageous manner only a very small spacing of the peripheral segments of the collecting cylinder surrounded by the two band guidances results, which, in turn, results in a high degree of operating safety and reliability. The small wedge-like region between the two band guidances can be bridged simply and advantageously be sheet guidances implemented as stationary guide tongues.

To attain a particularly high compactness, the bands of the two band guidances facing one another can be guided on the side of the collecting cylinder through rerouting rollers disposed adjacent one another and preferably freely rotatable on a common axle, and advantageously having different respective diameters.

In a further advantageous implementation of the above-described features, the plane of the web of one material web may be arranged to intersect the collecting cylinder in a secant-like manner, and wherein the material web passes through a transverse cutter which is disposed ahead of the rear tape guidance, as seen in the direction of rotation of the collecting cylinder, and preferably above the collecting cylinder.

Compared to the known devices, in which a plane of the web makes tangential contact with the collecting cylinder, there arises here in an advantageous manner an enlargement of the upper surrounding region of the collecting cylinder.

Due to the fact that the holding members of the collecting cylinder are preferably formed as flat simple grippers, it is insured that no collisions need be feared of the activatable grippers with the bands of the band guidance, which is associated with the cover sheets, and surrounds the front peripheral guidance. In the event of any use of a stapler associated with the collecting cylinder, the stapler may advantageously be disposed in a region of the peripheral segment surrounded by that band guidance which is associated with the covers. Hereby it is ensured that adhesion is only accomplished if all portions of a booklet are superimposed on one another. On the other hand, there results thereby a very compact arrangement, in which no significant space is required between the end of the above-named band guidance on the side of the cover sheets, and the folding flap cylinder.

In a further development of the above-noted measures, there may be provided a scanning device within a region of the tape guidance associated with the covers, the scanning device scanning the position of the covers and preferably operating optically, by means of which either a transverse cutter which is located upstream of the tape guidance associated with the covers, and/or a web of materials associated with the cover sheets, and/or a band guidance associated with the covers is controllable for advancement or resetting, from which features a further increase of the manufacturing accuracy can be expected.

According to a further advantageous embodiment, the band guidance associated with the covers may consist of at least of two successive segments, of which the respective front segment, as seen in the transport direction, is drivable faster that the respective segment located ahead of the front segment. Thereby, acceleration of the cover sheet web segments is accomplished in several stages, so as to attain the desired gaps from which, in turn, a careful treatment of the sheets results. Advantageously, the successive segments of the band guidance may include at least laterally displaced guidance bands off-set by the width of a band, and the segments may engage one another with their end regions facing one another in a prong-like or overlapping manner. As a result of this mutual overlap of the segments driven at different respective velocities, the web segments to be transported are transferred thereby from a slower travelling segment to a faster travelling segment, while maintaining their forcible guidance and alignment, without there being required guidance elements between the two segments which would be subject to wear and tear.

A further advantageous measure may consist in that the rear upper band roller of the inner band set of the respective front band guidance segment of the multiple band guidance and which travels faster, is adjustable height-wise. These measures permit a fine adjustment of the acceleration within the transfer region.

A further advantageous measure can consist in that in the region of the front and faster band guidance segment there is provided a stop periodically passing through the transport plane, whose velocity with respect to the band velocity is preferably slightly reduced. This measure permits a very high accuracy of rhythm of the cover sheets.

The present invention will be described and understood more readily when considered together with the accompanying drawings, in which:

FIG. 1 is a schematic side view of the adjustable or variable folding apparatus for manufacturing complete products with a two-stage acceleration of the separately supplied folded sheets, and FIG. 2 is a perspective view of a booklet having an outer cover consisting of thick material and an inner portion consisting of several sheets or pages of thinner material.

The folding apparatus shown in FIG. 1 includes a collecting cylinder 1 which is provided with adjustable holding members 2 in the form of grippers for gripping the leading edges of the web of papers supplied thereto and folding cutters 3, disposed on cylinder 1 between the holding members. Cooperating with collecting cylinder 1 is a cylinder, designated 4, having folding flaps 5 arranged thereon. Folding flaps 5 take over the packages of sheets transferred by folding cutters 3 while forming a transverse fold. The transversely-folded products are laid out in a known manner by means of a tape or band guidance and a shovel-wheel (not shown) which cooperate with folding flap cylinder 4.

The final product of manufacture are booklets such as the one illustrated in FIG. 2, which is generally designated 6, consisting of a cover 7 of thick material and an inner portion 8 of several thin sheets or pages. For the manufacture of such booklets 6, the apparatus includes two band guidances 9 and 10 associated with collecting cylinder 1, wherein the band guidances surround two peripheral segments 11 and 12, positioned one behind the other, of the collecting cylinder 1 upstream of folding flap cylinder 4. Transverse-cutting devices 13 and 14 are disposed upstream of the band or tape guidances 9 and 10, which subdivide the respective webs of material 15 and 16 into sheet-like segments. The sheet-like segments in turn are accelerated through band guidances 9 and 10 to the peripheral velocity of collecting cylinder 1 and are transferred thereto. Band guidances 9 and 10 are so driven that they cooperate free of any slippage with collecting cylinder 1. By means of band guidance 9, which surrounds the rear peripheral segment 11 as seen in the direction of rotation, collecting cylinder 1 receives the segments of web 15 to be carried together to make up the inner portion 8. Band guidance 10, surrounding or wrapped around the front peripheral segment 12 of collecting cylinder 1 as seen in the direction of rotation, supplies the web segments of web 16, which form covers 7, to collecting cylinder 1.

In order to obtain a large number of pages of booklets 6 to be manufactured, the paper track supplying web 15 is imprinted, so that several webbed segments of web 15 are collected with the aid of collecting cylinder 1 in a manner known such that they can be superimposed. For this purpose, folding cutters 3 are controlled in a manner known in such a way that not every sheet being taken over is immediately transferred or delivered, but remains during several rotations on collecting cylinder 1, so that several sheets superimposed upon one another are delivered in a package. Covers 7 are supplied in such a way that a cover sheet is set only on each inner package, which is formed by the collection process. The velocity of web 16 and of transverse cutting device 14 is therefore correspondingly reduced with respect to the velocity of web 15 and transverse cutting device 13. With the aid of band guidance 10, the segments of strand 16 forming cover 7 are accelerated to the peripheral velocity of collecting cylinder 1 such that gaps arise between two successive segments of the web. In the embodiment example illustrated, two segments each of the strand 15 are to be collected to form an inner portion 8 of booklet 6. For this purpose, collecting cylinder 1 is divided into 5 parts between holding members 2. Folding cutters 3 are so controlled, that each second folding cutter is activated upon passing folding flap cylinder 4. The velocity of web 16 and of transverse cutter 14 is 50% of the velocity of strand 15 and transverse cutter 13 associated therewith. The required gap between each set of two successive segments of strand 16, which form cover 7, corresponds to a length of the segment. The required acceleration therefore remains advantageously within limits. To the extent that this simple collection process for obtaining the desired number of pages of a booklet 6 to be manufactured is not adequate, it is possible to collect a multiple number of times.

The grippers forming holding members 2 are formed in the embodiment example illustrated as simple flat grippers. These initially grip the first segment of the web, transferred by band guidance 9 to collecting cylinder 1, and keep on gripping during the subsequent collecting process. Subsequent gripping is accomplished in the region of front peripheral segment 12 wherein all segments of inner portion 8 and the sheets forming the cover 10 of the booklet are superimposed upon one another, and are gripped. The simple flat grippers can accomplish a succeeding gripping without risk of damage; namely, they can be withdrawn, below the package of sheets, compressed by guidance 10. Following the end of a collecting process, the grippers, once they have passed folding flap cylinder 4, are opened when the following folding cutter 3 disposed therebehind is activated and comes into engagement with the respective oppositely-disposed folding flap 5 of cylinder 4. Prior to the transfer to folding flap cylinder 4, the sheets, which are superimposed upon one another, are stapled together. For this purpose, there is provided a stapling device 17 associated with collecting cylinder 1. Stapling device 17 may be placed, for the purpose of accomplishing a high degree of compactness and space-saving within front peripheral region 12 of collecting cylinder 1. The clamps for the booklets are always disposed in a respective region between the two guidance bands.

Transverse cutter 13 associated with web 15 is disposed above collecting cylinder 1. Transverse cutter 14 associated with web 16 is displaced parallel to cutter 13. Band guidance 9 surrounding rear peripheral segment 11 is therefore applied to collecting cylinder 1 from above. So as to accomplish the largest possible wrap-around, the operating position of transverse cutter 13 is off-set somewhat from the tangent to collecting cylinder 1 so that the plane of web 15 passing through transverse cutter 13 intersects collecting cylinder 1. In other words, the plane of web 15 passing through transverse cutter 13 intersects collecting cylinder 1 in a secant-like manner. Band guidance 10 surrounding the front peripheral segment 12 is applied from the side to the collecting cylinder 1 and is therefore rerouted by 90° from the original direction of web 16.

Band guidances 9 and 10 consist respectively of two band sets of different respective lengths which form adjoining tape guidance bands disposed next to and converging with one another. The respective longer and outer band set surrounds an associated peripheral segment of the collecting cylinder 1. The shorter inner band set ends in the peripheral region disposed ahead of the surrounding region. Outer band set 18 of band guidance 9 and inner band set 19 of band guidance 10 engage one another in the border region between the respective rear and front peripheral segments 11 and 12. The bands of band guidances 9 and 10 are therefore displaced on the side of the collecting cylinder by approximately the band width with respect to one another, and are guided by means of rerouting rollers 20 disposed next to one another. Rerouting rollers 20 can be disposed on a common axle extending over the width of the machine. The diameter of rollers 20 associated with the bands or tapes of inner band set 19 of band guidance 10 is somewhat smaller than the diameter of rollers 20 of the bands or tapes of outer band set 18 of band guidance 9. Thus, collisions of band set 19 with the collecting cylinder 1 not rolling thereon is reliably eliminated. In the wedge region between rerouting rollers 20 and the forward end of outer band set 18 as it comes into contact with collecting cylinder 1, there are provided sheet guidances 21 which may take the form of stationary guide tongues. It would also be conceivable to press the packages of sheets in the wedge region onto the periphery of the collecting cylinder by means of an air stream or the like.

Band guidance 10, through which the sheets are accelerated so as to obtain the required gaps, according to the collecting production between two sets of successive sheets, can, just as the band guidance 9 for supplying the web segments of inner portion 8, be formed in a single piece. Since covers 7 can be cut off from a prefabricated roll, no risk of smearing occurs within the region of the band or tape guidance 10, even during high acceleration. In the embodiment example illustrated, the band or tape guidance 10 consists of two successive segments 10*a* and 10*b*, whose velocity with respect to one another is graduated so that segment 10*b* disposed forwardly in the direction of transport rotates more quickly than the rear segment 10*a* disposed on the side of transverse cutter 14. By this arrangement, one can expect a particularly careful treatment of the segments of the web being accelerated. Segments 10*a* and 10*b* of guidance 10 may be disposed behind one another at a small spacing wherein the spacing is bridged by stationary guide tongues or the like. In the embodiment illustrated, the sequentially disposed band guidance segments 10*a* and 10*b* grip one another in a prong-like manner with the end regions overlapping and facing one another, which permits a direct transfer of the web segments being transported while maintaining their forceful guidance and therefore their alignment. The bands of the band guidance segments 10*a* and 10*b* are consequently off-set from one another by approximately their width. The length of the prong-like engagement, namely, the overlapping region of the band guidance segments 10*a* and 10*b* may be changed according to the length of the product. The transport planes of the band guidance segments cover one another in the overlapping region resulting in a trouble-free transfer thereat. So as to form a wedge-like inlet gap of front band guidance segment 10*b*, which travels faster in the transport direction, band roller 20, which is associated with the inner band set 19, is height-adjustable. This results in a particularly careful handling of the web segments being transported, while maintaining their forceful guidance in the transfer region between the segments 10*a* and 10*b*.

So as to accomplish a precise rhythm of the segments of web 16 prior to transfer to the collection cylinder 1, there is provided within the region of the front band guidance segment 10*b* a stop 23, which periodically passes into the transport plane of the tape guidance. Stop 23 is disposed outside of the overlapping region with the rear band guidance segment 10*a* and travels at a velocity which is somewhat reduced with respect to the velocity of the band or tape. The leading edges of the web segments transported by tape guidance 10 meet stop 23 and are therefore exactly aligned at a correct rhythm. So as to form stop 23, there is provided a rotating shaft 24 onto which there are set disk-shaped plates 25, positioned so as to fill a gap extending in relation of the associated guidance bands, gripping between two respective bands and including radially extending fingers forming stop 23. Shaft 24 can advantageously be driven continuously.

The position of the web segments forming a respective cover 7 is scanned by an optical scanning device 26 within the region of front segment 10*b* so that an exact superpositioning may be accomplished of the package of sheets forming inner portion 8 and the associated cover 7. Alternatively, scanning device 26 may be utilized to control the advancement or resetting of transverse cutter 14 or to control the advancement or resetting of the web supply members 27 thereby controlling web 16. In the case of a two-part embodiment of band guidance 10, in lieu thereof, also rear tape guidance 10*a* could appropriately be advanced or reset.

It is understood that the foregoing general and detailed descriptions are not to be interpreted as restrictive of the following claims.

What is claimed is:

1. An adjustable folding apparatus for the manufacture of products such as booklets having an outer covering and an inner portion, from an outer covering web and an inner portion web, comprising:

(a) a collecting cylinder;

(b) a first band guidance surrounding a rear peripheral segment in the direction of rotation of said collecting cylinder, cooperating therewith in a slip-free manner, said first band guidance transferring to said collecting cylinder for collection thereon sheet segments forming the inner portion of said booklet, successive rotations of said collecting cylinder collecting in a superimposed manner said inner portion sheet segments;

(c) a second band guidance surrounding a front peripheral segment in the direction of rotation of said collecting cylinder, said front peripheral segment being successively positioned with respect to said rear peripheral segment, said second band guidance cooperating with said peripheral segment in a slip-free manner and transferring to said collecting cylinder sheet segments forming at least one outer covering of said booklet at intervals corresponding to the collection process;

(d) controlled holding members in the form of flat grippers disposed on said collecting cylinder for gripping the leading edges of sheet segments transferred to said collecting cylinder, said holding members being activated at each rotation of said collecting cylinder within the region of said front peripheral segment; and (e) a folding flap cylinder associated with said collecting cylinder and disposed in front of said front and rear peripheral segments in the direction of rotation of said collecting cylinder and adapted to have transferred from said collecting cylinder superimposed inner portion sheet segments and outer covering sheet segment;

said controlled holding members being inactivated following the completed collection process after passing said folding flap cylinder thus allowing the transfer of the superimposed inner portion sheet segments and outer covering sheet segment from said collecting cylinder to said folding flap cylinder.

2. The adjustable folding apparatus as defined in claim 1, wherein the bands of said first and second band guidances are displaced on the side of said collection cylinder laterally with respect to one another at least by a band width.

3. The adjustable folding apparatus as defined in claim 2, wherein the bands of said first and second band guidances are guided on the side of said collecting cylinder through rerouting rollers disposed adjacent one another, and rotatably disposed on a common axle.

4. The adjustable folding apparatus as defined in claim 3, wherein said rerouting rollers disposed adjacent one another are of different respective diameters.

5. The adjustable folding apparatus as defined in claim 1, which further comprises a sheet guidance in the form of stationary guide tongues provided in the wedge region between the first and second band guidances at the collecting cylinder.

6. The adjustable folding apparatus as defined in claim 1, wherein the plane of the inner portion web intersects the collecting cylinder in a secant-like manner, and wherein the inner portion web passes through a transverse cutter which is disposed ahead of said first band guidance, as seen in the direction of rotation of the collecting cylinder, and above the collecting cylinder.

7. The adjustable folding apparatus as defined in claim 1, which further comprises a stapling device associated with said collecting cylinder disposed in the region of the front peripheral segment of said collecting cylinder.

8. The adjustable folding apparatus as defined in claim 1, which further comprises an optical scanning device within the region of said second band guidance, the scanning device scanning the position of the outer covering sheet segments and controlling said second band guidance for advancement of said sheet segments.

9. The adjustable folding apparatus as defined in claim 1, which further comprises an optical scanning device within the region of said second band guidance, the scanning device scanning the position of the outer covering sheet segments, and a transverse cutter upstream from said second band guidance for cutting said outer covering web, the advancement of which is controlled by said scanning device.

10. The adjustable folding apparatus as defined in claim 8, wherein said scanning device controls the advancement of said outer covering web into a transverse cutter upstream from said second band guidance.

11. The adjustable folding apparatus as defined in claim 1, wherein said second band guidance consists of at least two successive segments of which the front segment, as seen in the transport direction, is drivable faster than the other segment.

12. The adjustable folding apparatus as defined in claim 11, wherein said successive segments of said second band guidance includes at least laterally displaced guidance bands off-set by the width of the band, and said segments engage one another with the end regions facing one another in a prong-like or overlapping manner.

13. The adjustable folding apparatus as defined in claim 12, wherein said segments of said second band guidance define in the mutual overlapping region approximately the same transport planes.

14. The adjustable folding apparatus as defined in claim 11, wherein said mutual overlapping region of the band guidance segments is adjustable according to the size of the booklet format.

15. The adjustable folding apparatus as defined in claim 11, wherein the rear roller of the front band guidance segment is height-wise adjustable.

16. The adjustable folding apparatus as defined in claim 11, which further comprises a stop periodically passing through the transport plane in the region of the front band guidance segment.

17. The adjustable folding apparatus as defined in claim 16, wherein said stop includes a throughgoing shaft provided external to the overlapping region of the successive band guidance segments, and clamps spaced from one another and gripping through and between the respective bands received by the throughgoing shaft.

18. The adjustable folding apparatus as defined in claim 17, wherein the clamps forming the stop are implemented as radially-extending fingers of a disk disposed on said shaft and filling the gap defined by the bands of said band guidance segments.

19. The adjustable folding apparatus as defined in claim 16, wherein the engagement time period of the stop is adjustable.

* * * * *